US011007792B2

(12) United States Patent
Kanatake et al.

(10) Patent No.: US 11,007,792 B2
(45) Date of Patent: May 18, 2021

(54) THERMAL TRANSFER PRINTER

(71) Applicant: Mitsubishi Electric Corporation, Tokyo (JP)

(72) Inventors: Yusuke Kanatake, Tokyo (JP); Makoto Sakuwa, Tokyo (JP); Kosuke Oda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 45 days.

(21) Appl. No.: 16/470,468

(22) PCT Filed: Sep. 13, 2018

(86) PCT No.: PCT/JP2018/033913
§ 371 (c)(1),
(2) Date: Jun. 17, 2019

(87) PCT Pub. No.: WO2020/054007
PCT Pub. Date: Mar. 19, 2020

(65) Prior Publication Data

US 2020/0307249 A1 Oct. 1, 2020

(51) Int. Cl.
*B41J 2/35* (2006.01)
*B41J 2/325* (2006.01)
*B41J 33/34* (2006.01)

(52) U.S. Cl.
CPC ..... *B41J 2/325* (2013.01); *B41J 2/35* (2013.01); *B41J 33/34* (2013.01)

(58) Field of Classification Search
CPC ..... B41J 2/325; B41J 2/3558; B41J 2/35
See application file for complete search history.

(56) References Cited

U.S. PATENT DOCUMENTS 4,012,674 A 3/1977 Spitsbergen et al.
5,573,202 A * 11/1996 Morgavi ..... B41J 35/18 242/534.2

(Continued)

FOREIGN PATENT DOCUMENTS

FR 2306920 A1 5/1976
JP 2007-062032 A 3/2007
JP 4343036 B2 10/2009

OTHER PUBLICATIONS

Extended European Search Report for coresponding European Application No. 18899022.0, dated Jan. 30, 2020.

(Continued)

*Primary Examiner* — Sharon Polk
(74) *Attorney, Agent, or Firm* — Birch, Stewart, Kolasch & Birch, LLP

(57) ABSTRACT

An object is to provide a thermal transfer printer having an inexpensive configuration and capable of making a tension given to an ink ribbon as constant as possible, even when a secular change and an environmental change occur in a DC motor used as a supply motor and a winding motor. A supply motor control unit controls a supply motor of an ink ribbon supply unit. A winding motor control unit controls a winding motor of an ink ribbon winding unit. A remaining amount detection unit detects a remaining amount of an ink ribbon. A variable calculation unit acquires parameters for an armature current, an applied voltage, and a rotational speed of each of the supply motor and the winding motor, and calculates variables to be used for controlling the supply motor and the winding motor on the basis of the acquired parameters.

12 Claims, 4 Drawing Sheets

(56) References Cited

U.S. PATENT DOCUMENTS

| | | | | |
|---|---|---|---|---|
| 10,647,139 | B1 * | 5/2020 | Kitahara | B41J 2/325 |
| 2014/0225970 | A1 | 8/2014 | Lakin et al. | |

OTHER PUBLICATIONS

International Search Report for PCT/JP2018/033913 (PCT/ISA/210) dated Nov. 27, 2018, with English translation.
Chinese Office Action dated Feb. 2, 2021 in corresponding Chinese Application No. 20180011835.3 with an English Translation.

* cited by examiner

THERMAL TRANSFER PRINTER

TECHNICAL FIELD

The present invention relates to a thermal transfer printer that performs printing on a sheet by using an ink ribbon.

BACKGROUND ART

A thermal transfer printer produces one printed matter by performing the following processing. First, a sheet is conveyed at a constant speed by a conveyance motor. While the sheet is conveyed, a supply motor supplies an ink ribbon and a winding motor winds the ink ribbon. Next, the sheet and the ink ribbon are pressed by a thermal head and a platen roller. Finally, the ink ribbon is heated by the thermal head, and the ink applied to the ink ribbon is thermally transferred to the sheet.

During the thermal transfer of the ink to the sheet, the ink ribbon is required to be supplied and wound at a constant tension. When the tension of the ink ribbon on the winding side is small, the pressed sheet and ink ribbon cannot be separated, and the sheet gets stuck. This phenomenon is called jam. When the tension is large, wrinkles occur in the printed matter.

For example, Patent Document 1 discloses a technique for making a tension given to an ink ribbon constant by changing a voltage applied to a DC motor that winds the ink ribbon, in accordance with a remaining amount of the ink ribbon.

Further, Patent Document 2 discloses a technique of detecting a load of a sheet conveyance motor by a torque sensor, and changing a rotational speed of the conveyance motor in accordance with a comparison result between the detected load and a reference value. When the technique described in Patent Document 2 is applied to a winding motor, a load on the motor can be made constant, so that the tension of the ink ribbon can be made constant.

PRIOR ART DOCUMENTS

Patent Documents

Patent Document 1: Japanese Patent Application Laid-Open No. 2007-62032

Patent Document 2: Japanese Patent No. 4343036

SUMMARY

Problem to be Solved by the Invention

When a DC motor is used for a long time, a magnetic flux density of a magnetic field generated in a stator of the DC motor changes from an initial state. This is called a secular change. Further, by changes in environments such as temperature and humidity where a DC motor is used, a magnetic flux density and armature resistance are changed. This is called an environmental change. Even when an applied voltage to the DC motor is the same, if the secular change and the environmental change occur, generated torque cannot be made constant and a tension given to the ink ribbon cannot be made constant. In the technology described in Patent Document 1, since the secular change and the environmental change are not taken into consideration, a tension given to the ink ribbon cannot be made constant.

Moreover, in the technique described in Patent Document 2, there is a problem that the cost of the apparatus is increased because the torque sensor is used. Meanwhile, a tension sensor may be used instead of the torque sensor, but the cost of the apparatus is similarly increased.

Therefore, it is an object of the present invention to provide a thermal transfer printer having an inexpensive configuration and capable of making a tension given to an ink ribbon as constant as possible, even when a secular change and an environmental change occur in a DC motor used as a supply motor and a winding motor.

Means to Solve the Problem

A thermal transfer printer according to the present invention is a thermal transfer printer that performs printing on a sheet by using an ink ribbon. The thermal transfer printer includes: a thermal transfer unit having a thermal head to press and heat the sheet and the ink ribbon; an ink ribbon supply unit having a supply bobbin to supply the ink ribbon to the thermal transfer unit, and a supply motor to rotate the supply bobbin; a supply motor control unit to control the supply motor of the ink ribbon supply unit; an ink ribbon winding unit having a winding bobbin to wind the ink ribbon, and a winding motor to rotate the winding bobbin; a winding motor control unit to control the winding motor of the ink ribbon winding unit; a remaining amount detection unit to detect a remaining amount of the ink ribbon; and a variable calculation unit to acquire parameters for an armature current, an applied voltage, and a rotational speed of each of the supply motor and the winding motor while voltages are applied to the supply motor and the winding motor respectively from the supply motor control unit and the winding motor control unit, and to calculate variables to be used for controlling the supply motor and the winding motor on the basis of the acquired parameters.

Effects of the Invention

According to the present invention, it is possible to make a tension given to an ink ribbon as constant as possible even when a secular change and an environmental change occur in a DC motor used as a supply motor and a winding motor, with an inexpensive configuration without using a torque sensor and a tension sensor.

Objects, features, aspects, and advantages of the present invention will become more apparent from the following detailed description and the accompanying drawings.

DESCRIPTION OF EMBODIMENTS

First Embodiment

Figure 1:
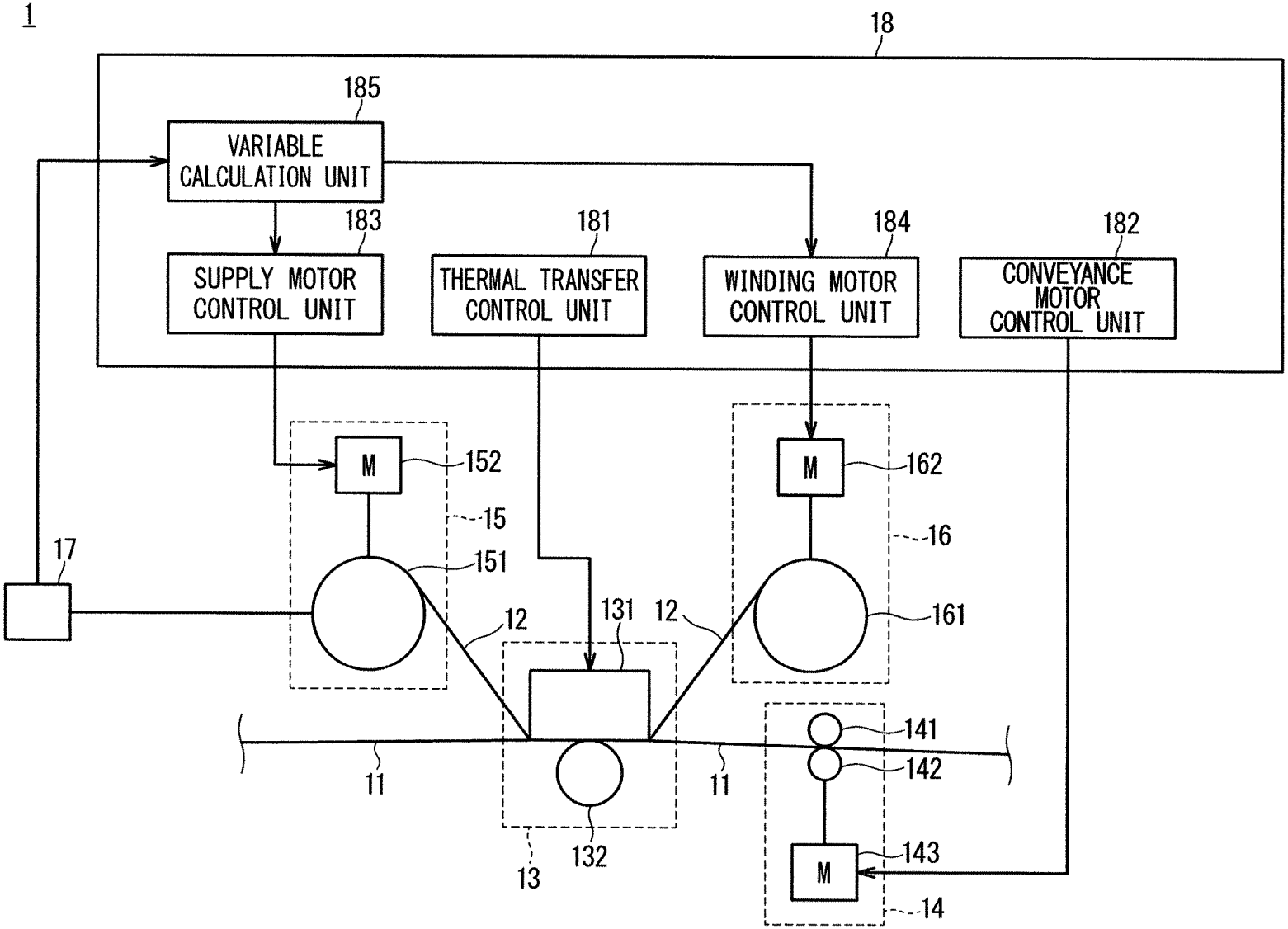
FIG. 1 is a diagram showing a configuration of a thermal transfer printer according to a first embodiment.

A first embodiment of the present invention will be described below with reference to the drawings. FIG. 1 is a diagram showing a configuration of a thermal transfer printer 1 according to the first embodiment.

As shown in FIG. 1, the thermal transfer printer 1 according to the first embodiment includes a thermal transfer unit 13, a sheet conveyance unit 14, an ink ribbon supply unit 15, an ink ribbon winding unit 16, a remaining amount detection unit 17, and a central control unit 18.

The thermal transfer unit 13 includes a thermal head 131 and a platen roller 132. The thermal head 131 presses and heats a sheet 11 and an ink ribbon 12 in accordance with a control signal from a thermal transfer control unit 181 in the central control unit 18. The platen roller 132 is pressed against the thermal head 131 at the time of thermal transfer, and forms a thermal transfer region between the platen roller 132 and the thermal head 131.

The sheet conveyance unit 14 includes a conveyance roller 141, a conveyance roller 142, and a conveyance motor 143. The conveyance rollers 141 and 142 nip and convey the sheet 11 in between. The conveyance motor 143 is connected to one conveyance roller of the conveyance rollers 141 and 142, and rotates the conveyance roller at a constant speed. The conveyance motor is, for example, a stepping motor. In addition, the one of the conveyance rollers is the conveyance roller 142 in the case of FIG. 1.

The ink ribbon supply unit 15 includes a supply bobbin 151 and a supply motor 152. The supply bobbin 151 supplies the ink ribbon 12 wound in a roll shape to the thermal transfer unit 13. The supply motor 152 is connected to the supply bobbin 151 and rotates the supply bobbin 151. Thus, the ink ribbon 12 is supplied to the thermal transfer unit 13. The supply motor 152 is, for example, a DC motor.

The ink ribbon winding unit 16 includes a winding bobbin 161 and a winding motor 162. The winding bobbin 161 winds up the ink ribbon 12. The winding motor 162 is connected to the winding bobbin 161 and rotates the winding bobbin 161. Thus, the ink ribbon 12 is wound around the winding bobbin 161. The winding motor 162 is, for example, a DC motor.

The remaining amount detection unit 17 detects a remaining amount of the ink ribbon 12. The remaining amount detection unit 17 is connected to the supply bobbin 151, for example, and reads a predetermined mark formed at a constant interval on the ink ribbon 12, with a mark sensor (not shown). The remaining amount detection unit 17 supplies a read signal to a variable calculation unit 185 in the central control unit 18.

The central control unit 18 includes the thermal transfer control unit 181, a conveyance motor control unit 182, a supply motor control unit 183, a winding motor control unit 184, and the variable calculation unit 185. The thermal transfer control unit 181 controls the thermal head 131. The conveyance motor control unit 182 controls the conveyance motor 143. The supply motor control unit 183 controls the supply motor 152. The winding motor control unit 184 controls the winding motor 162.

The variable calculation unit 185 acquires parameters for an armature current, an applied voltage, and a rotational speed of each of the supply motor 152 and the winding motor 162, and calculates variables of the supply motor 152 and the winding motor 162 on the basis of the acquired parameters. The variables are variables to be used for controlling the supply motor 152 and the winding motor 162, and are a torque constant and armature resistance. The armature current is detected using, for example, a conversion resistor (not shown) to convert a current into a voltage, and an amplifier (not shown) to amplify a voltage. Further, the rotational speed is detected using, for example, an encoder (not shown). An operation of the variable calculation unit 185 will be described later with reference to FIGS. 2 to 5. Meanwhile, the central control unit 18 is configured by a central processing unit (CPU).

The variable calculation unit 185 may calculate the variables of the supply motor 152 and the winding motor 162 at any timing. For example, the timing may be in a period from a start of printing to a start of thermal transfer, may be during thermal transfer, or may be immediately after power is turned on. Hereinafter, a case where the variable calculation unit 185 calculates variables from a start of printing to a start of thermal transfer will be described.

The supply bobbin 151 and the winding bobbin 161 need to rotate such that a tension of the ink ribbon 12 is constant. For this purpose, it is necessary to make generated torque of the supply motor 152 and the winding motor 162 constant. However, when a DC motor is used as the supply motor 152 and the winding motor 162, occurrence of a secular change and an environmental change causes the generated torque to change because the variables (a torque constant and armature resistance) of the DC motor change. An amount of the environmental change can be quantitatively determined if an ambient temperature can be grasped, but the secular change is unknown. Therefore, an amount of change in the DC motor variable is unknown.

Accordingly, if a value of the variable of the DC motor can be obtained in advance, an applied voltage to the DC motor or a target value of current control at the time of thermal transfer can be calculated, and the generated torque can be made constant. Hereinafter, a description is given to a method of calculating an applied voltage to the DC motor or a target value of current control by calculating a variable of the DC motor and using the calculated variable.

An applied voltage V to the DC motor is expressed by the following Equation (1), by using an armature current I, a rotational speed N, armature resistance R, an armature inductance L, and a back electromotive force constant $K_e$.

[Formula 1]

$$y = L\frac{dI}{dt} + RI + K_e N \qquad \text{Equation (1)}$$

Since the armature inductance L is small, it is ignored. From Equation (1), the rotational speed N is expressed by the following Equation (2).

[Formula 2]

$$N = \frac{V}{K_e} - \frac{R}{K_e} I \qquad \text{Equation (2)}$$

From Equation (2), the armature current I and the rotational speed N have a relationship of a primary line with a gradient of $-R/K_e$ and an intercept of $V/K_e$.

Figure 2:
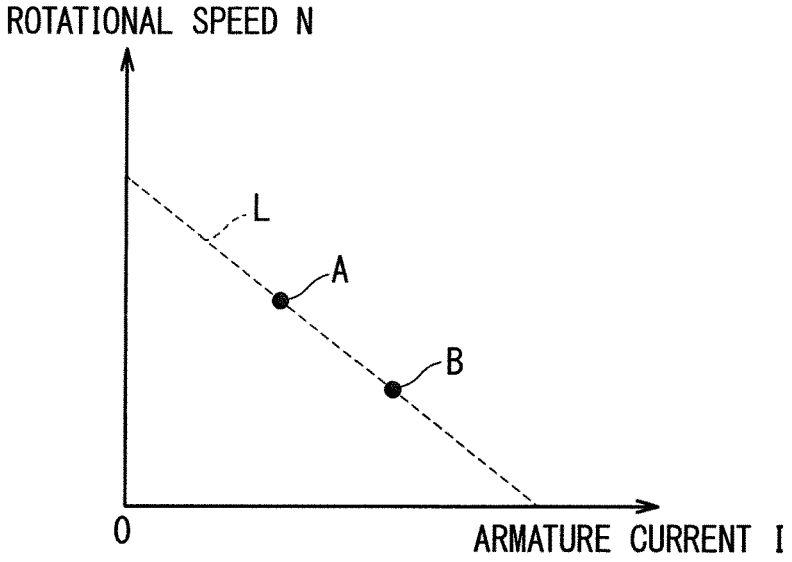
FIG. 2 is a graph showing a relationship between an armature current and a rotational speed of a DC motor in the thermal transfer printer according to the first embodiment.

FIG. 2 is a graph showing a relationship between the armature current I and the rotational speed N of the DC motor in the thermal transfer printer according to the first embodiment.

In FIG. 2, a horizontal axis represents the armature current I of the DC motor, a vertical axis represents the rotational speed N of the DC motor, and a broken line L is a primary line of the rotational speed N with respect to the armature current I when the applied voltage V is constant.

From Equation (2), when the applied voltage V is constant, the back electromotive force constant $K_e$ and the armature resistance R can be calculated on the basis of armature currents $I_A$ and $I_B$, applied voltages $V_A$ and $V_B$, and rotational speeds $N_A$ and $N_B$ at two different points A and B. Meanwhile, $V_A=V_B=V$ is satisfied.

In order to make generated torque of the DC motor constant, it is necessary to calculate a torque constant $K_t$, which is a proportional coefficient of the armature current I and generated torque T. However, since the torque constant $K_t$ and the back electromotive force constant $K_e$ are generally equal, the torque constant $K_t$ can be calculated. By substituting the armature currents $I_A$ and $I_B$, the applied voltages $V_A$ and $B_B$, and the rotational speeds $N_A$ and $N_B$ at the two different points A and B into Equation (2), the torque constant $K_t$ and the armature resistance R are respectively expressed b the following Equations (3) and (4).

[Formula 3]

$$K_t = K_e = \frac{V_A I_B - V_B I_A}{N_A I_B - N_B I_A} \quad \text{Equation (3)}$$

[Formula 4]

$$R = \frac{V_B N_A - V_A N_B}{N_A I_B - N_B I_A} \quad \text{Equation (4)}$$

After calculating the torque constant $K_t$ and the armature resistance R by the Equations (3) and (4), the supply motor control unit 183 applies a constant voltage $V_{tgt_sp}$ to the supply motor 152 at the time of thermal transfer, while the winding motor control unit 184 applies a constant voltage $V_{tgt_tu}$ to the winding motor 162 at the time of thermal transfer. Alternatively, the supply motor control unit 183 may perform current control such that a target value of the armature current of the supply motor 152 becomes $I_{tgt_sp}$, while the winding motor control unit 184 may perform current control such that a target value of the armature current of the winding motor 162 becomes $I_{tgt_tu}$. First, a method of calculating $V_{tgt_sp}$ and $V_{tgt_tu}$ in a case of applying a constant voltage will be described.

When a constant voltage is applied to the supply motor 152, an armature current and a rotational speed become constant after a predetermined time has elapsed since the start of the application. Assuming that, at a time when the armature current and the rotational speed become constant, the armature current is $I_1$, the applied voltage is $V_1$ ($=V_A=V_B=V$), and the rotational speed is $N_1$, the applied voltage $V_1$ is expressed by the following Equation (5).

[Formula 5]

$$V_1=K_e N_1+RI_1 \quad \text{[Equation 5]}$$

Whereas, a tension starts to be generated for the ink ribbon 12 on the supply side when an ink ribbon supply speed and a sheet conveyance speed become the same, and the tension at this time is zero. A rotational speed of the supply motor 152 calculated from the ink ribbon supply speed and a remaining amount of the ink ribbon 12 at this time is defined as $N_2$. An applied voltage $V_2$ required to set the rotational speed to $N_2$ is expressed by the following Equation (6) by using an armature current $I_2$ at this time.

[Formula 6]

$$V_2=K_e N_2+RI_2 \quad \text{Equation (6)}$$

The armature currents $I_1$ and $I_2$ are loss currents caused by moving the supply bobbin 151, and are calculated from, for example, load torque of the supply bobbin 151 and the torque constant $K_t$. Since the tension of the ink ribbon 12 at the applied voltage $V_2$ is zero, $I_1$ and $I_2$ are equal if the tension of the ink ribbon 12 at the applied voltage $V_1$ is zero. The applied voltage $V_2$ at this time is expressed by the following Equation (7) by using the Equations (5) and (6).

[Formula 7]

$$V_2=V_1+K_e(N_2-N_1) \quad \text{Equation (7)}$$

Required torque calculated from a remaining amount of the ink ribbon 12 and a required tension is defined as $T_{tgt_sp}$. Here, the required tension is a target value of a tension given to the ink ribbon 12. The tension is generated when $V_{tgt_sp}$ is less than the applied voltage $V_2$ at which the tension starts to be generated. Furthermore, since the ink ribbon 12 on the supply side is dragged by the sheet 11 to be supplied, the ink ribbon supply speed is always equal to or greater than the sheet conveyance speed. Therefore, a rotational speed at the applied voltage $V_{tgt_sp}$ is equal to the rotational speed $N_2$ at the applied voltage $V_2$. Consequently, the applied voltage $V_{tgt_sp}$ is expressed by the following Equation (8) by using the Equations (5) to (7).

[Formula 8]

$$\begin{aligned} V_{tgt_sp} &= K_e N_2 + R\left(I_2 - \frac{T_{tgt\,sp}}{K_t}\right) \quad \text{Equation (8)} \\ &= V_2 - R \cdot \frac{T_{tgt_sp}}{K_t} \\ &= V_1 + K_e(N_2 - N_1) - R \cdot \frac{T_{tgt_sp}}{K_t} \end{aligned}$$

From Equation (8), the voltage $V_{tgt_sp}$ to be applied to the supply motor 152 at the time of thermal transfer can be calculated. However, the rotational speed $N_1$ in calculating the torque constant $K_t$ and the armature resistance R needs to be larger than the rotational speed $N_2$ when tension starts to be generated. That is, in calculating the torque constant $K_t$ and the armature resistance R, it is necessary to make sure that a tension is not to be generated in the ink ribbon 12. If the rotational speed $N_1$ is equal to or smaller than $N_2$, on the supply side, the ink ribbon 12 is dragged by the sheet 11 to be conveyed, and a tension is generated, causing $I_1 \neq I_2$. This disables accurate calculation of the voltage $V_{tgt_sp}$ to be applied to the supply motor 152 at the time of thermal transfer. Therefore, when the torque constant $K_t$ and the armature resistance R are calculated, it is necessary to set the applied voltage $V_1$ such that the ink ribbon supply speed is greater than the sheet conveyance speed.

For the winding motor 162 as well, the voltage $V_{tgt_tu}$ to be applied to the winding motor 162 at the time of thermal transfer can be calculated with the same concept as described above. However, there is a difference from the supply motor 152 in the following points. Required torque calculated from a remaining amount of the ink ribbon 12 and a required tension is defined as $T_{tgt_tu}$. Here, the required tension is a target value of a tension given to the ink ribbon 12. The tension is generated when $V_{tgt_tu}$ is larger than the applied voltage $V_2$ at which the tension starts to be generated. Furthermore, since the ink ribbon 12 on the winding side is integrated with the sheet 11 at the thermal head 131, the ink ribbon winding speed is always equal to or smaller than the sheet conveyance speed, Therefore, a rotational speed at the applied voltage $V_{tgt_tu}$ is equal to the rotational speed $N_2$ at the applied voltage $V_2$. Consequently, $V_{tgt_tu}$ is expressed by the following Equation (9) by using the Equations (5) to (7).

[Formula 9]

$$V_{tgt_tu} = K_e N_2 + R\left(I_2 + \frac{T_{tgt_tu}}{K_t}\right) = V_2 + R \cdot \frac{T_{tgt_tu}}{K_t} = V_1 + K_e(N_2 - N_1) + R \cdot \frac{T_{tgt_tu}}{K_t} \quad \text{Equation (9)}$$

From Equation (9), the voltage $V_{tgt_tu}$ to be applied to the winding motor 162 at the time of thermal transfer can be calculated. However, the rotational speed $N_1$ in calculating the torque constant $K_t$ and the armature resistance R needs to be smaller than the rotational speed. $N_2$ when tension starts to be generated. That is, in calculating the torque constant $K_t$ and the armature resistance R, it is necessary to make sure that a tension is not to be generated in the ink ribbon 12. If the rotational speed $N_1$ is equal to or greater than $N_2$, on the winding side, the ink ribbon 12 is separated from the sheet 11 to be conveyed, and a tension is generated, causing $I_1 \neq I_2$. This disables accurate calculation of the voltage $V_{tgt_tu}$ to be applied to the winding motor 162 at the time of thermal transfer. Therefore, when the torque constant $K_t$ and the armature resistance R are calculated, it is necessary to set the applied voltage $V_1$ such that the ink ribbon winding speed is smaller than the sheet conveyance speed.

Next, a method of calculating the target currents $I_{tgt_sp}$ and $I_{tgt_tu}$ in a case of performing current control will be described.

In the case of the supply motor 152, the target current $I_{tgt_sp}$ is expressed by the following Equation (10) by using Equation (5).

[Formula 10]

$$I_{tgt_sp} = I_1 - \frac{T_{tgt_tu}}{K_t} = \frac{V_1 - K_e N_1}{R} - \frac{T_{tgt_tu}}{K_t} \quad \text{Equation (10)}$$

In the case of the winding motor 162, the target current $I_{tgt_tu}$, is expressed by the following Equation (11) by using Equation (5).

[Formula 11]

$$I_{tgt_tu} = I_1 + \frac{T_{tgt_tu}}{K_t} = \frac{V_1 - K_e N_1}{R} + \frac{T_{tgt_tu}}{K_t} \quad \text{Equation (11)}$$

The method of calculating a variable of the DC motor and calculating an applied voltage to the DC motor or a target value of current control has been described above. In the above description, the applied voltages $V_A$ and $V_B$ at the two points A and B are the same, but the applied voltages $V_A$ and $V_B$ may be different.

Figure 3:
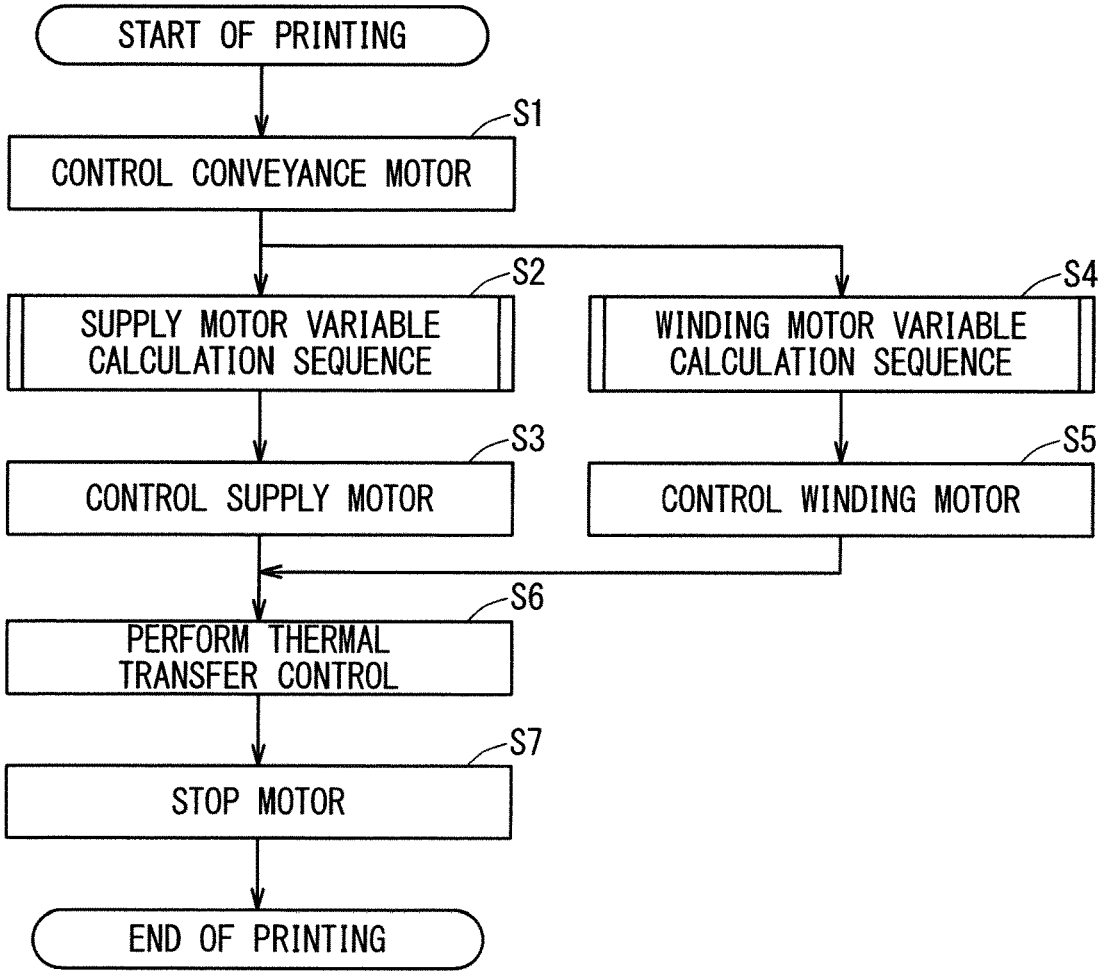
FIG. 3 is a flowchart showing an example of processing from a start to an end of printing in the thermal transfer printer according to the first embodiment.

FIG. 3 is a flowchart showing an example of processing from a start to an end of printing in the thermal transfer printer according to the first embodiment. In other words, FIG. 3 is a flowchart in a case where the variable calculation unit 185 calculates variables from a start of printing to a start of thermal transfer.

As shown in FIG. 3, when printing is started, the conveyance motor control unit 182 controls the conveyance motor 143 (step S1). The conveyance motor control unit 182 controls the conveyance motor 143 on the basis of, for example, a speed profile.

Next, the variable calculation unit 185 executes a variable calculation sequence of the supply motor 152 (step S2). Details of the processing of step S2 will be described later with reference to a flowchart of FIG. 4.

Next, the supply motor control unit 183 controls the supply motor 152 (step S3). Specifically, the supply motor control unit 183 applies a constant voltage $V_{tgt_sp}$ to the supply motor 152. Alternatively, the supply motor control unit 183 performs current control such that a target value of the armature current of the supply motor 152 becomes $I_{tgt_sp}$.

After the conveyance motor control unit 182 performs the processing of step S1, the variable calculation unit 185 executes a variable calculation sequence of the winding motor 162 in parallel with the processing of step S2 (step S4). Details of the processing of step S4 will be described later with reference to a flowchart of FIG. 5.

Next, the winding motor control unit 184 controls the winding motor 162 (step S5). Specifically, the winding motor control unit 184 applies a constant voltage $V_{tgt_tu}$ to the winding motor 162. Alternatively, the winding motor control unit 184 performs current control such that a target value of the armature current of the winding motor 162 becomes $I_{tgt_tu}$.

Next, the thermal transfer control unit 181 performs thermal transfer control on the thermal head 131, to start thermal transfer (step S6).

Next, the conveyance motor control unit 182, the supply motor control unit 183, and the winding motor control unit 184 respectively stop the conveyance motor 143, the supply motor 152, and the winding motor 162 (step S7). Note that the processing of step S7 is executed after the thermal transfer is completed.

Figure 4:
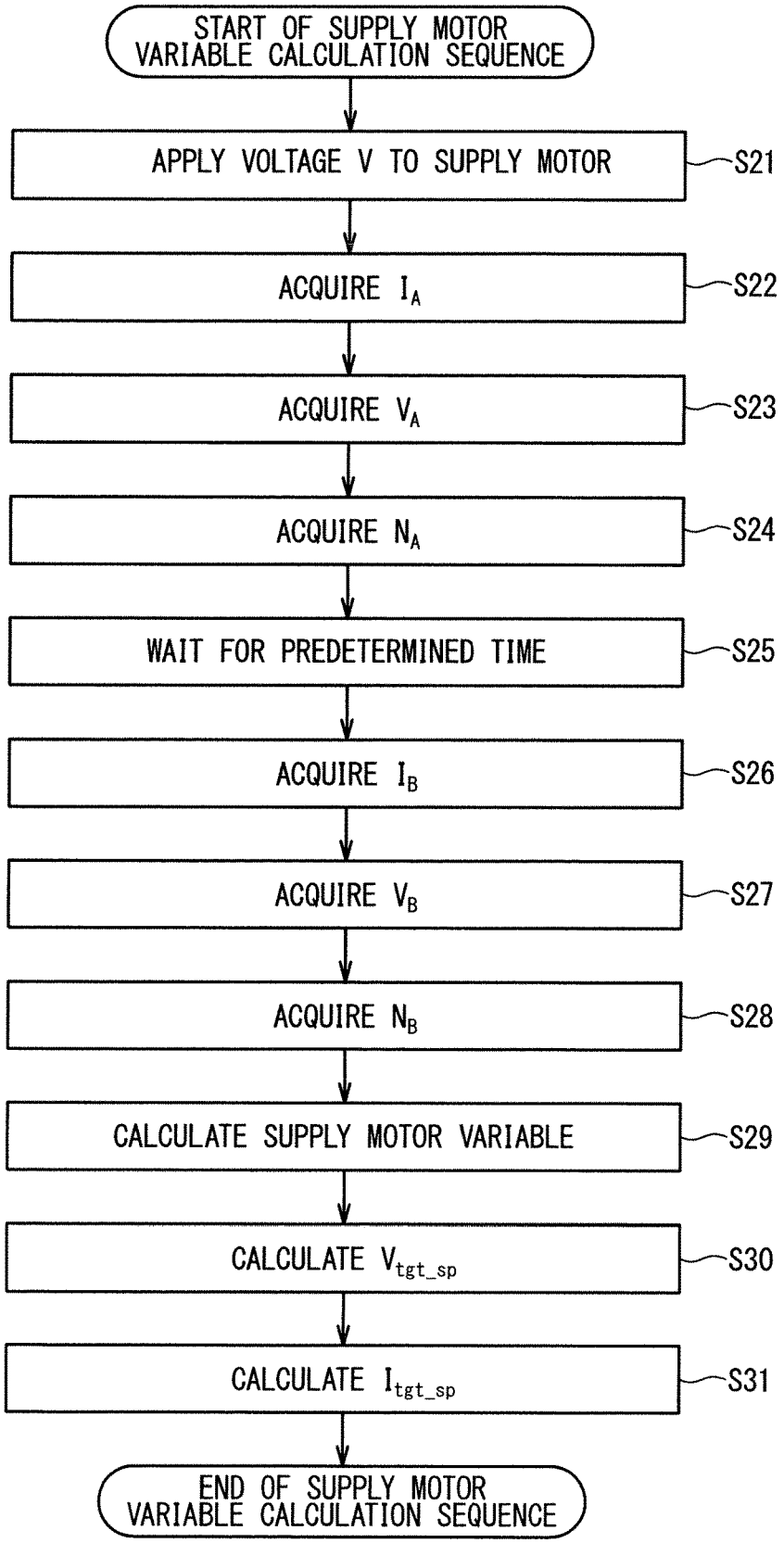
FIG. 4 is a flowchart showing an example of a supply motor variable calculation sequence in the thermal transfer printer according to the first embodiment.

FIG. 4 is a flowchart showing an example of a supply motor variable calculation sequence in the thermal transfer printer according to the first embodiment. Specifically, FIG. 4 shows details of the supply motor variable calculation sequence in step S2 of FIG. 3, and is a flowchart in a case where the applied voltages $V_A$ and $V_B$ at the two points A and B are the same, that is, in a case of the voltage V.

As shown in FIG. 4, when the supply motor variable calculation sequence is started by the variable calculation unit 185, the supply motor control unit 183 applies the voltage V to the supply motor 152 (step S21).

Next, the variable calculation unit 185 acquires the armature current $I_A$ of the supply motor 152 (step 22).

Next, the variable calculation unit 185 acquires the applied voltage $V_A$ of the supply, motor 152. (step S23). Meanwhile, $V_A$=V is satisfied.

Next, the variable calculation unit 185 acquires the rotational speed $N_A$ of the supply motor 152 (step S24).

Next, the variable calculation unit 185 waits for a predetermined time (step S25). The reason why the processing of step S25 is performed is to acquire the armature currents $I_A$, and $I_B$, the applied voltages $V_A$ and $V_B$, and the rotational speeds $N_A$ and $N_B$ at the two different points A and B in FIG. 2.

Next, the variable calculation unit 185 acquires the armature current $I_B$ of the supply motor 152 (step S26).

Next, the variable calculation unit 185 acquires the applied voltage $V_B$ of the supply motor 152 (step S27). Meanwhile, $V_B$=V is satisfied.

Next, the variable calculation unit 185 acquires the rotational speed $N_B$ of the supply motor 152 (step S28).

Next, the variable calculation unit 185 calculates variables (the torque constant $K_t$ and the armature resistance R) of the supply motor 152 by using the Equations (3) and (4) (step S29).

Next, the variable calculation unit 185 calculates the applied voltage $V_{tgt_sp}$ by using Equation (8) (step S30).

Next, the variable calculation unit 185 calculates the target value $I_{tgt_sp}$ of the armature current by using Equation (10) (step S31).

Next, the variable calculation unit 185 ends the supply motor variable calculation sequence.

Note that, in step S3, in a case where the supply motor control unit 183 applies the constant voltage $V_{tgt_sp}$ to the supply motor 152, the variable calculation unit 185 does not need to perform the processing of step S31. Similarly, in a case where the supply motor control unit 183 performs current control such that a target value of the armature current of the supply motor 152 becomes $I_{tgt_sp}$, the variable calculation unit 185 does not need to perform the processing of step S30.

In the supply motor variable calculation sequence shown in FIG. 4, a combination of the two different points A and B is one set, and the calculated torque constant $K_t$ and armature resistance R are also one set, but the combination of two points may be two or more. In this case, the torque constant $K_t$ and the armature resistance R to be calculated are also two or more, and for example, average values of these are adopted as the torque constant $K_t$ and the armature resistance R.

Figure 5:
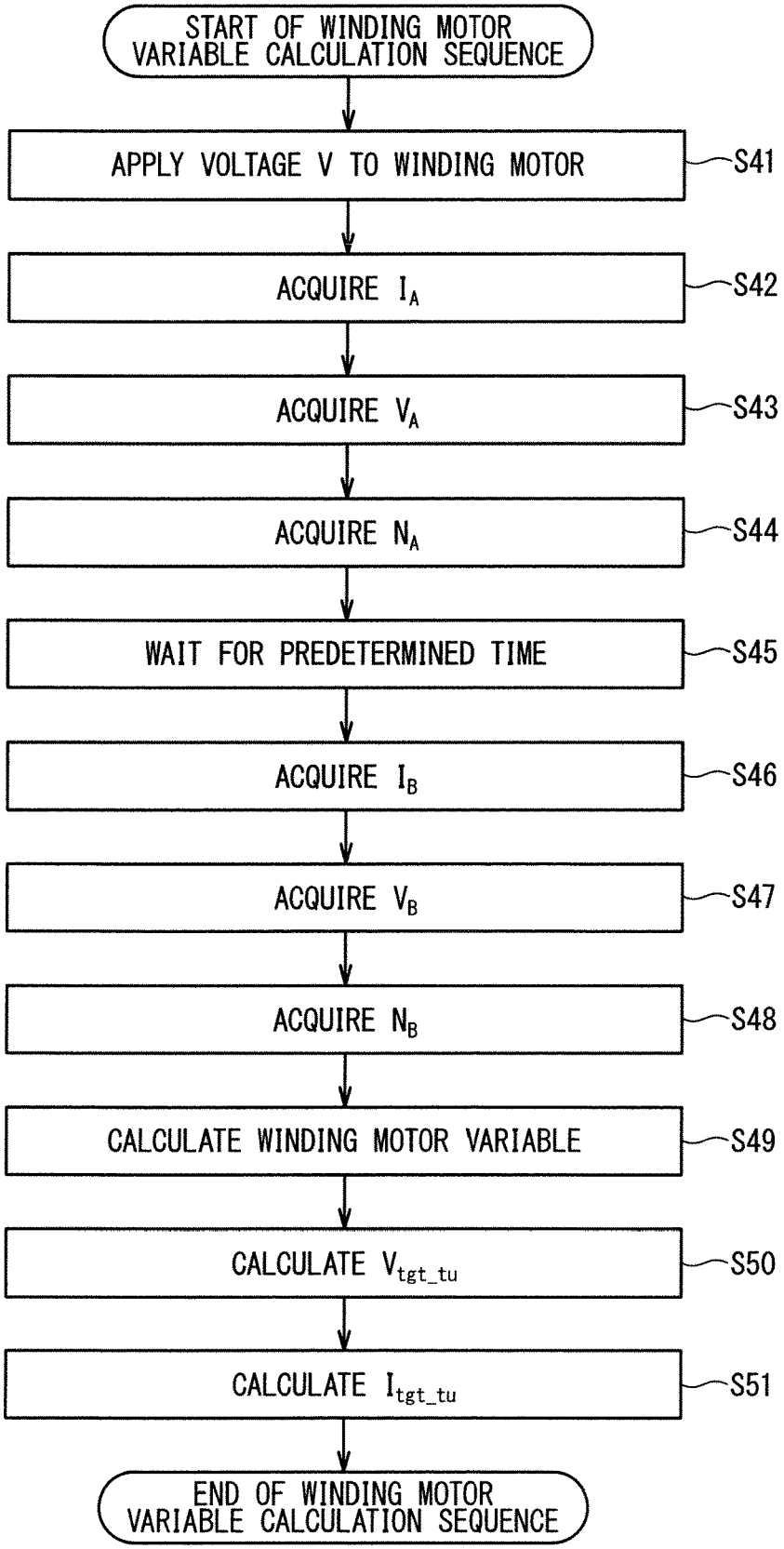
FIG. 5 is a flowchart showing an example of a winding motor variable calculation sequence in the thermal transfer printer according to the first embodiment.

FIG. 5 is a flowchart showing an example of a winding motor variable calculation sequence in the thermal transfer printer according to the first embodiment. Specifically, FIG. 5 shows details of the winding motor variable calculation sequence in the step S5 of FIG. 3, and is a flowchart in a case where the applied voltages $V_A$ and $V_B$ at the two points A and B are the same, that is, in a case of the voltage V.

As shown in FIG. 5, when the winding motor variable calculation sequence is started by the variable calculation unit 185, the winding motor control unit 184 applies the voltage V to the winding motor 162 (step S41). However, the applied voltage V in the processing of step S41 is different from the applied voltage V in the processing of step S21.

Next, the variable calculation unit 185 acquires the armature current $I_A$ of the winding motor 162 (step S42).

Next, the variable calculation unit 185 acquires the applied voltage $V_A$ of the winding motor 162 (step S43). Meanwhile, $V_A$=V is satisfied.

Next, the variable calculation unit 185 acquires the rotational speed $N_A$ of the winding motor 162 (step S44).

Next, the variable calculation unit 185 waits for a predetermined time (step S45). The reason why the processing of step S45 is performed is to acquire the armature currents $I_A$ and $I_B$, the applied voltages $V_A$ and $V_B$, and the rotational speeds $N_A$ and $N_B$ at the two different points A and B in FIG. 2.

Next, the variable calculation unit 185 acquires the armature current $I_B$ of the winding motor 162 (step S46).

Next, the variable calculation unit 185 acquires the applied voltage $V_B$ of the winding motor 162 (step S47). Meanwhile, $V_B$=V is satisfied.

Next, the variable calculation unit 185 acquires the rotational speed $N_B$ of the winding motor 162. (step S48).

Next, the variable calculation unit 185 calculates variables (the torque constant $K_t$ and the armature resistance R) of the winding motor 162 by using the Equations (3) and (4) (step S49).

Next, the variable calculation unit 185 calculates the applied voltage $V_{tgt_tu}$ by using Equation (9) (step S50).

Next, the variable calculation unit 185 calculates the target value $I_{tgt_tu}$ of the armature current by using Equation (11) (step S51).

Next, the variable calculation unit 185 ends the winding motor variable calculation sequence.

Note that, in step S5, in a case where the winding motor control unit 184 applies the constant voltage $V_{tgt_tu}$ to the winding motor 162, the variable calculation unit 185 does not need to perform the processing of step S51. Similarly, in a case where the winding motor control unit 184 performs current control such that a target value of the armature current of the winding motor 162 becomes $I_{tgt_tu}$, the variable calculation unit 185 does not need to perform the processing of step S50.

In the winding motor variable calculation sequence shown in FIG. 5, a combination of the two different points A and B is one set, and the calculated torque constant $K_t$ and armature resistance R are also one set, but the combination of two points may be two or more. In this case, the torque constant $K_t$ and the armature resistance R to be calculated are also two or more, and for example, average values of these are adopted as the torque constant $K_t$ and the armature resistance R.

As described above, in the thermal transfer printer 1 according to the first embodiment, the variable calculation unit 185 acquires parameters for an armature current, an applied voltage, and a rotational speed of each of the supply motor 152 and the winding motor 162 while voltages are applied to the supply motor 152 and the winding motor 162 respectively from the supply motor control unit 183 and the winding motor control unit 184, and calculates variables to be used for controlling the supply motor 152 and the winding motor 162 on the basis of the acquired parameters.

Since it is possible to calculate an applied voltage to the supply motor 152 and the winding motor 162 or a target value of current control by using the calculated variables, the supply motor 152 and the winding motor 162 can be controlled by using these target values.

Specifically, the variables calculated by the variable calculation unit 185 include a torque constant and armature resistance. Furthermore, at the time of thermal transfer, the supply motor control unit 183 applies, to the supply motor 152, a voltage calculated on the basis of a torque constant, armature resistance, a remaining amount of the ink ribbon, and a target value of a tension given to the ink ribbon 12, and, at the time of thermal transfer, the winding motor control unit 184 applies, to the winding motor 162, a voltage calculated on the basis of a torque constant, armature resistance, a remaining amount of the ink ribbon 12, and a target value of a tension given to the ink ribbon 12. Alternatively, at the time of thermal transfer, the supply motor control unit 183 uses, as a target current, a current calculated on the basis of a torque constant, armature resistance, a remaining amount of the ink ribbon 12, and a target value of a tension given to the ink ribbon 12 to perform current control of the supply motor 152, and, at the time of thermal transfer, the winding motor control unit 184 uses, as a target current, a current calculated on the basis of a torque constant, armature resistance, a remaining amount of the ink ribbon 12, and a target value of a tension given to the ink ribbon 12 to perform current control of the winding motor 162.

Therefore, it is possible to make a tension given to the ink ribbon 12 as constant as possible even when a secular change and an environmental change occur in the DC motor used as the supply motor 152 and the winding motor 162, with an inexpensive configuration without using a torque sensor and a tension sensor.

In addition, from the calculation results of variables of the supply motor 152 and the winding motor 162, it is possible to quantitatively grasp a secular change of both motors. As one example, when the secular change exceeds a predetermined value, the thermal transfer printer 1 determines that the supply motor 152 or the winding motor 162 has malfunctioned, and urges replacement of the supply motor 152 or the winding motor 162. Thus, failure diagnosis of the thermal transfer printer 1 can be performed.

The thermal transfer printer 1 further includes: a sheet conveyance unit 14 having conveyance rollers 141 and 142 to convey the sheet 11, and a conveyance motor 143 to rotate the conveyance rollers 141 and 142; and a conveyance motor control unit 182 to control the conveyance motor 143 of the sheet conveyance unit 14. The supply motor control unit 183 sets a voltage to be applied to the supply motor 152 at the time of acquisition of a parameter such that an ink ribbon supply speed is greater than a sheet conveyance speed by the conveyance motor 143. Therefore, on the supply side, the ink ribbon 12 is not dragged by the sheet 11 and no tension is generated, so that the voltage $V_{tgt_sp}$ to be applied to the supply motor 152 at the time of thermal transfer can be accurately calculated.

The thermal transfer printer 1 further includes: a sheet conveyance unit 14 having conveyance rollers 141 and 142 to convey the sheet 11, and a conveyance motor 143 to rotate the conveyance rollers 141 and 142; and a conveyance motor control unit 182 to control the conveyance motor 143 of the sheet conveyance unit 14. The winding motor control unit 184 sets the voltage to be applied to the winding motor 162 at the time of acquisition of a parameter such that an ink ribbon winding speed is smaller than a sheet conveyance speed by the conveyance motor 143. Therefore, on the winding side, the ink ribbon 12 is not separated from the sheet 11 and no tension is generated, so that the voltage $V_{tgt_tu}$ to be applied to the winding motor 162 at the time of thermal transfer can be accurately calculated.

Second Embodiment

Next, a thermal transfer printer 1 according to a second embodiment will be described. Note that, in the second embodiment, the same constituent elements as those described in the first embodiment are denoted by the same reference numerals, and a description thereof will be omitted.

In the first embodiment, a description has been given to the case where the supply motor control unit 183 applies the constant voltage $V_{tgt_sp}$ to the supply motor 152 at the time of thermal transfer, and the winding motor control unit 184 applies the constant voltage $V_{tgt_tu}$ to the winding motor 162. Alternatively, a description has been given to the case where the supply motor control unit 183 performs current control such that a target value of the armature current of the supply motor 152 becomes $I_{tgt_sp}$, and the winding motor control unit 184 performs current control such that a target value of the armature current of the winding motor 162 becomes $I_{tgt_tu}$.

However, on the winding side, it is necessary to separate the ink ribbon 12 from the thermally transferred sheet 11, and a force required for separation changes every moment due to a color density or the like of the sheet 11. In this case, if the winding motor 162 is controlled with a constant applied voltage or a constant armature current, the ink ribbon 12 cannot be wound with a constant tension. Accordingly, In the second embodiment, a description is given to a case where a voltage applied to a winding motor 162 is changed at the time of thermal transfer, or a case where a target value of an armature current is changed to perform current control.

The thermal transfer printer 1 according to the second embodiment has the same configuration as the thermal transfer printer 1 according to the first embodiment, and thus the description thereof will be omitted.

When a force required to separate the ink ribbon 12 from the sheet 11 is large, if the winding motor 162 is controlled with a constant applied voltage or a constant armature current, an ink ribbon winding speed decreases, and a tension of the ink ribbon 12 decreases. On the contrary, when a force required to separate the ink ribbon 12 from the sheet 11 is small, if the winding motor 162 is controlled with a constant applied voltage or a constant armature current, an ink ribbon winding speed increases, and a tension of the ink ribbon 12 increases.

Thus, when the tension of the ink ribbon 12 fluctuates, the ink ribbon winding speed fluctuates. Since a rotational speed of the winding motor 162 is proportional to the ink ribbon winding speed, the rotational speed of the winding motor 162 also fluctuates. Therefore, in order to make the tension of the ink ribbon 12 constant, the rotational speed of the winding motor 162 may simply be made constant.

Specifically, at the time of thermal transfer, the rotational speed of the winding motor 162 is detected, the ink ribbon winding speed calculated from the detected rotational speed is compared with a sheet conveyance speed, and a voltage applied to the winding motor 162 is changed from $V_{tgt_tu}$ in accordance with the comparison result. Alternatively, in accordance with the comparison result, a target value of an armature current of the winding motor 162 is changed from $I_{tgt_tu}$ to perform current control. The change of the applied voltage or the change of the target value of the armature current may be always performed during the thermal transfer, or may be performed only when a difference between the ink ribbon winding speed and the sheet conveyance speed is large. Although the above describes the winding motor 162, similar processing may also be performed for the supply motor 152.

As described above, in the thermal transfer printer 1 according to the second embodiment, the supply motor control unit 183 changes the calculated voltage on the basis of the rotational speed of the supply motor 152 acquired at the time of thermal transfer, to apply the changed voltage to the supply motor 152, while the winding motor control unit 184 changes the calculated voltage on the basis of the rotational speed of the winding motor 162 detected at the time of thermal transfer, to apply the changed voltage to the winding motor 162.

Alternatively, the supply motor control unit 183 changes the calculated target current on the basis of the rotational speed of the supply motor 152 acquired at the time of thermal transfer, to perform current control of the supply motor 152, while the winding motor control unit 184 changes the calculated target current on the basis of the rotational speed of the winding motor 162 acquired at the time of thermal transfer, to perform current control of the winding motor 162.

Therefore, even if a force required to separate the ink ribbon 12 from the sheet 11 fluctuates due to a color density or the like of the sheet 11, a tension given to the ink ribbon 12 can be made constant.

While the present invention has been described in detail, the foregoing description is in all aspects illustrative and the present invention is not limited thereto. It is understood that innumerable modifications not illustrated can be envisaged without departing from the scope of the present invention.

It should be noted that the present invention can freely combine respective embodiments within the scope of the invention, and can modify or omit each embodiment as appropriate.

EXPLANATION OF REFERENCE SIGNS

1: thermal transfer printer
11: sheet
12: ink ribbon
13: thermal transfer unit
14: sheet conveyance unit
15: ink ribbon supply unit
16: ink ribbon winding unit
17: remaining amount detection unit
131: thermal head
141, 142: conveyance roller
143: conveyance motor
151: supply bobbin
152: supply motor
61: winding bobbin
162: winding motor
182: conveyance motor control unit
183: supply motor control unit
184: winding motor control unit
185: variable calculation unit

The invention claimed is:

1. A thermal transfer printer that performs printing on a sheet by using an ink ribbon, the thermal transfer printer comprising:

a thermal transfer unit having a thermal head to press and heat the sheet and the ink ribbon;

an ink ribbon supply unit having a supply bobbin to supply the ink ribbon to the thermal transfer unit, and a supply motor to rotate the supply bobbin;

a supply motor control unit to control the supply motor of the ink ribbon supply unit;

an ink ribbon winding unit having a winding bobbin to wind the ink ribbon, and a winding motor to rotate the winding bobbin;

a winding motor control unit to control the winding motor of the ink ribbon winding unit;

a remaining amount detection unit to detect a remaining amount of the ink ribbon; and a variable calculation unit to acquire parameters for an armature current, an applied voltage, and a rotational speed of each of the supply motor and the winding motor while voltages are applied to the supply motor and the winding motor respectively from the supply motor control unit and the winding motor control unit, and to calculate variables to be used for controlling the supply motor and the winding motor based on the acquired parameters, wherein the calculated variable used for controlling the supply motor and the winding motor aid the thermal transfer printer to achieve a tension in the ink ribbon that is approximately constant in the presence of a secular change and an environmental change in the supply motor and the winding motor, and the supply motor and the winding motor are DC motors.

2. The thermal transfer printer according to claim 1, wherein the variable calculated by the variable calculation unit includes a torque constant and armature resistance.

3. The thermal transfer printer according to claim 2, wherein the supply motor control unit applies, at a time of thermal transfer, to the supply motor, a voltage calculated based on the torque constant, the armature resistance, a remaining amount of the ink ribbon, and a target value of a tension given to the ink ribbon, and the winding motor control unit applies, at a time of thermal transfer, to the winding motor, a voltage calculated based on the torque constant, the armature resistance, a remaining amount of the ink ribbon, and a target value of a tension given to the ink ribbon.

4. The thermal transfer printer according to claim 3, wherein the supply motor control unit changes the calculated voltage based on the rotational speed of the supply motor acquired at a time of thermal transfer, to apply the changed voltage to the supply motor, and the winding motor control unit changes the calculated voltage based on the rotational speed of the winding motor detected at a time of thermal transfer, to apply the changed voltage to the winding motor.

5. The thermal transfer printer according to claim 2, wherein the supply motor control unit uses, as a target current, at a time of thermal transfer, a current calculated based on the torque constant, the armature resistance, a remaining amount of the ink ribbon, and a target value of a tension given to the ink ribbon, to perform current control of the supply motor, and the winding motor control unit uses, as a target current, at a time of thermal transfer, a current calculated based on the torque constant, the armature resistance, a remaining amount of the ink ribbon, and a target value of a tension given to the ink ribbon, to perform current control of the winding motor.

6. The thermal transfer printer according to claim 5, wherein the supply motor control unit changes the calculated target current based on the rotational speed of the supply motor acquired at a time of thermal transfer, to perform current control of the supply motor, and the winding motor control unit changes the calculated target current based on the rotational speed of the winding motor acquired at a time of thermal transfer, to perform current control of the winding motor.

7. The thermal transfer printer according to claim 2, further comprising:

a sheet conveyance unit having a conveyance roller to convey the sheet, and a conveyance motor to rotate the conveyance roller; and a conveyance motor control unit to control the conveyance motor of the sheet conveyance unit, wherein the supply motor control unit sets a voltage to be applied to the supply motor at a time of acquisition of parameters for an armature current, an applied voltage, and a rotational speed of the supply motor to cause an ink ribbon supply speed to be greater than a sheet conveyance speed by the conveyance motor.

8. The thermal transfer winter according to claim 2, further comprising:

a sheet conveyance unit having a conveyance roller to convey the sheet, and a conveyance motor to rotate the conveyance roller; and a conveyance motor control unit to control the conveyance motor of the sheet conveyance unit, wherein the winding motor control unit sets a voltage to be applied to the winding motor at a time of acquisition of parameters for an armature current, an applied voltage, and a rotational speed of the winding motor to cause an ink ribbon winding speed to be smaller than a sheet conveyance speed by the conveyance motor.

9. A thermal transfer printer that performs printing on a sheet by using an ink ribbon, the thermal transfer printer comprising:

a thermal transfer unit having a thermal head to press and heat the sheet and the ink ribbon;

an ink ribbon supply unit having a supply bobbin to supply the ink ribbon to the thermal transfer unit, and a supply motor to rotate the supply bobbin;

a supply motor control unit to control the supply motor of the ink ribbon supply unit;

an ink ribbon winding unit having a winding bobbin to wind the ink ribbon, and a winding motor to rotate the winding bobbin;

a winding motor control unit to control the winding motor of the ink ribbon winding unit;

a remaining amount detection unit to detect a remaining amount of the ink ribbon; and a variable calculation unit to acquire parameters for an armature current, an applied voltage, and a rotational speed of each of the supply motor and the winding motor while voltages are applied to the supply motor and the winding motor respectively from the supply motor control unit and the winding motor control unit, and to calculate variables to be used for controlling the supply motor and the winding motor based on the acquired parameters, wherein the supply motor and the winding motor are DC motors, the variable calculated by the variable calculation unit includes a torque constant and armature resistance, the supply motor control unit applies, at a time of thermal transfer, to the supply motor, a voltage calculated based on the torque constant, the armature resistance, a remaining amount of the ink ribbon, and a target value of a tension given to the ink ribbon, and the winding motor control unit applies, at a time of thermal transfer, to the winding motor, a voltage calculated based on the torque constant, the armature resistance, a remaining amount of the ink ribbon, and a target value of a tension given to the ink ribbon.

10. A thermal transfer printer that performs printing on a sheet by using an ink ribbon, the thermal transfer printer comprising:

a thermal transfer unit having a thermal head to press and heat the sheet and the ink ribbon;

an ink ribbon supply unit having a supply bobbin to supply the ink ribbon to the thermal transfer unit, and a supply motor to rotate the supply bobbin;

a supply motor control unit to control the supply motor of the ink ribbon supply unit;

an ink ribbon winding unit having a winding bobbin to wind the ink ribbon, and a winding motor to rotate the winding bobbin;

a winding motor control unit to control the winding motor of the ink ribbon winding unit;

a remaining amount detection unit to detect a remaining amount of the ink ribbon; and a variable calculation unit to acquire parameters for an armature current, an applied voltage; and a rotational speed of each of the supply motor and the winding motor while voltages are applied to the supply motor and the winding motor respectively from the supply motor control unit and the winding motor control unit, and to calculate variables to be used for controlling the supply motor and the winding motor based on the acquired parameters, wherein the supply motor and the winding motor are DC motors, the variable calculated by the variable calculation unit includes a torque constant and armature resistance, the supply motor control unit uses, as a target current, at a time of thermal transfer, a current calculated based on the torque constant; the armature resistance; a remaining amount of the ink ribbon, and a target value of a tension given to the ink ribbon, to perform current control of the supply motor, and the winding motor control unit uses, as a target current, at a time of thermal transfer, a current calculated based on the torque constant, the armature resistance, a remaining amount of the ink ribbon, and a target value of a tension given to the ink ribbon, to perform current control of the winding motor.

11. A thermal transfer printer that performs printing on a sheet by using an ink ribbon, the thermal transfer printer comprising:

a thermal transfer unit having a thermal head to press and heat the sheet and the ink ribbon;

an ink ribbon supply unit having a supply bobbin to supply the ink ribbon to the thermal transfer unit, and a supply motor to rotate the supply bobbin;

a supply motor control unit to control the supply motor of the ink ribbon supply unit;

an ink ribbon winding unit having a winding bobbin to wind the ink ribbon, and a winding motor to rotate the winding bobbin;

a winding motor control unit to control the winding motor of the ink ribbon winding unit;

a remaining amount detection unit to detect a remaining amount of the ink ribbon;

a variable calculation unit to acquire parameters for an armature current, an applied voltage, and a rotational speed of each of the supply motor and the winding motor while voltages are applied to the supply motor and the winding motor respectively from the supply motor control unit and the winding motor control unit, and to calculate variables to be used for controlling the supply motor and the winding motor based on the acquired parameters;

a sheet conveyance unit having a conveyance roller to convey the sheet, and a conveyance motor to rotate the conveyance roller; and a conveyance motor control unit to control the conveyance motor of the sheet conveyance unit, wherein the supply motor and the winding motor are DC motors, the variable calculated by the variable calculation unit includes a torque constant and armature resistance, the supply motor control unit sets a voltage to be applied to the supply motor at a time of acquisition of parameters for an armature current, an applied voltage, and a rotational speed of the supply motor to cause an ink ribbon supply speed to be greater than a sheet conveyance speed by the conveyance motor.

12. A thermal transfer printer that performs printing on a sheet by using an ink ribbon, the thermal transfer printer comprising:

a thermal transfer unit having a thermal head to press and heat the sheet and the ink ribbon;

an ink ribbon supply unit having a supply bobbin to supply the ink ribbon to the thermal transfer unit, and a supply motor to rotate the supply bobbin;

a supply motor control unit to control the supply motor of the ink ribbon supply unit;

an ink ribbon winding unit having a winding bobbin to wind the ink ribbon, and a winding motor to rotate the winding bobbin;

a winding motor control unit to control the winding motor of the ink ribbon winding unit;

a remaining amount detection unit to detect a remaining amount of the ink ribbon;

a variable calculation unit to acquire parameters for an armature current, an applied voltage, and a rotational speed of each of the supply motor and the winding motor while voltages are applied to the supply motor and the winding motor respectively from the supply motor control unit and the winding motor control unit, and to calculate variables to be used for controlling the supply motor and the winding motor based on the acquired parameters;

a sheet conveyance unit having a conveyance roller to convey the sheet, and a conveyance motor to rotate the conveyance roller; and a conveyance motor control unit to control the conveyance motor of the sheet conveyance unit, wherein the supply motor and the winding motor are DC motors, the variable calculated by the variable calculation unit includes a torque constant and armature resistance, the winding motor control unit sets a voltage to be applied to the winding motor at a time of acquisition of parameters for an armature current, an applied voltage, and a rotational speed of the winding motor to cause an ink ribbon winding speed to be smaller than a sheet conveyance speed by the conveyance motor.

* * * * *